United States Patent [19]

Stoll

[11] Patent Number: 4,646,623

[45] Date of Patent: Mar. 3, 1987

[54] ACTUATOR CYLINDER

[76] Inventor: Kurt Stoll, Lenzhalde 72, 7300 Esslingen, Fed. Rep. of Germany

[21] Appl. No.: 704,538

[22] Filed: Feb. 22, 1985

[30] Foreign Application Priority Data

Feb. 24, 1984 [DE] Fed. Rep. of Germany ..... 3406644

[51] Int. Cl.[4] ..... F01B 31/14

[52] U.S. Cl. ..... 92/13.5; 92/13.41; 92/128

[58] Field of Search ..... 92/13, 13.4, 13.5, 13.6, 92/13.41, 128

[56] References Cited

U.S. PATENT DOCUMENTS

| | | | |
|---|---|---|---|
| 1,571,044 | 1/1926 | DaCosta | 92/13.6 |
| 1,888,392 | 11/1932 | Penick | 92/13.6 |
| 3,003,470 | 10/1961 | Geyer | 92/13.5 |
| 3,080,852 | 3/1963 | Geyer | 92/13.6 |
| 3,945,302 | 3/1976 | Downs | 92/13.41 |

FOREIGN PATENT DOCUMENTS

| | | | |
|---|---|---|---|
| 0082807 | 6/1980 | Japan | 92/13.6 |
| 1218053 | 1/1971 | United Kingdom . | |

*Primary Examiner*—Abraham Hershkovitz
*Attorney, Agent, or Firm*—McGlew and Tuttle

[57] ABSTRACT

A cylinder actuator has a cylinder barrel, a piston running axially therein, a piston rod running through a first end plate and a stop for limiting motion of the plunger (made up of the piston and its piston rod) by cooperation with an abutment on the plunger. The maximum extent to which the piston rod may be moved out of the barrel is adjustable. The stop mounted within the cylinder is in the form of a radial projection mounted on a stop rod and able to be adjusted in the axial direction. The stop rod extends from the second cylinder and plate along a coaxial hole in the stop rod. This hole has a part of small diameter adjacent to said second end plate and a part of large diameter remote therefrom, said large and small diameters joining at a radial shoulder in said stop rod, said shoulder forming said abutment. The radial projection is located in the hole part with the large diameter.

5 Claims, 3 Drawing Figures

ACTUATOR CYLINDER

BACKGROUND OF THE INVENTION

The invention relates to actuator cylinders, more particularly for operation by compressed air, with a cylinder barrel shut off at one end, a piston able to run backwards and forwards axially in the barrel and mounted on a piston rod protruding from the barrel through a first cylinder end plate, and a stop for limiting the maximum amount of extension of the piston rod from the barrel by cooperation with the moving plunger as formed by the piston and the piston rod.

In known arrangements of this type as so far proposed the piston rod has a part joined to it that is placed outside one end plate to serve as an abutment for cooperation with a stop placed at a distance from the end plate and which may be axially adjusted to set the maximum extension of the piston rod from the cylinder barrel. Such piston and cylinder units frequently have to be used for applications in which space is at a premium, as for example in a machine tool processing some form of workpiece, so that the presence of such an external system of abutments increasing the space requirement of the piston and cylinder unit is likely to be more than a marginal disadvantage. Furthermore, the abutment system may be fouled by dirt and because the one abutment acts eccentrically, there may be appreciable signs of wear after running for only a short time. Moreover, the abutment system, that also has to keep its set position, puts up the costs of manufacturing the piston and cylinder unit.

SHORT SUMMARY OF THE INVENTION

For this reason one object of the invention is to devise a piston and cylinder unit of the sort referred to initially that is more resistant to wear.

A further aim of the invention is to design an actuator cylinder that has a smaller space requirement than previous designs.

Yet another objective of the present innovation is to keep the manufacturing costs of such an actuator cylinder as low as possible.

In order to effect these and further aims, in a construction with first and second end plates at the ends of the cylinder barrel, the plunger has an axial hole that has a part of small diameter adjacent to the second end plate of the unit, and a part of large diameter merging therewith at a radial shoulder forming the abutment, the stop limiting the outward stroke of the plunger by cooperation with the abutment and being formed by an axially adjusting radial projection placed in the part of the axial hole with a large diameter, so that there is at least sliding play between the projection and the wall of the hole part with a large diameter, said stop being on a stop rod that is mounted on the second end plate from which it runs into the axial hole to pass through the part of the axial hole with the small diameter, with at least sliding play, to extend into that part of the hole with the large diameter, where it carries the radial projection.

In contradistinction to the prior art it will be apparent from this that the stop is no longer mounted outside the actuator cylinder so that the overall size of the cylinder is not changed by the addition of the abutment arrangement. Simultaneously the abutment system is kept out of the way of dirt. A further point is that the stop and abutment cooperate centrally so that tilting moments are not produced and wear is minimized.

An account will now be given of one illustrative working example of the invention using the figures and with indications of various possible modifications and further developments.

LIST OF THE VARIOUS VIEWS OF THE DRAWINGS

DETAILED ACCOUNT OF WORKING EXAMPLE OF THE INVENTION

Figure 1:
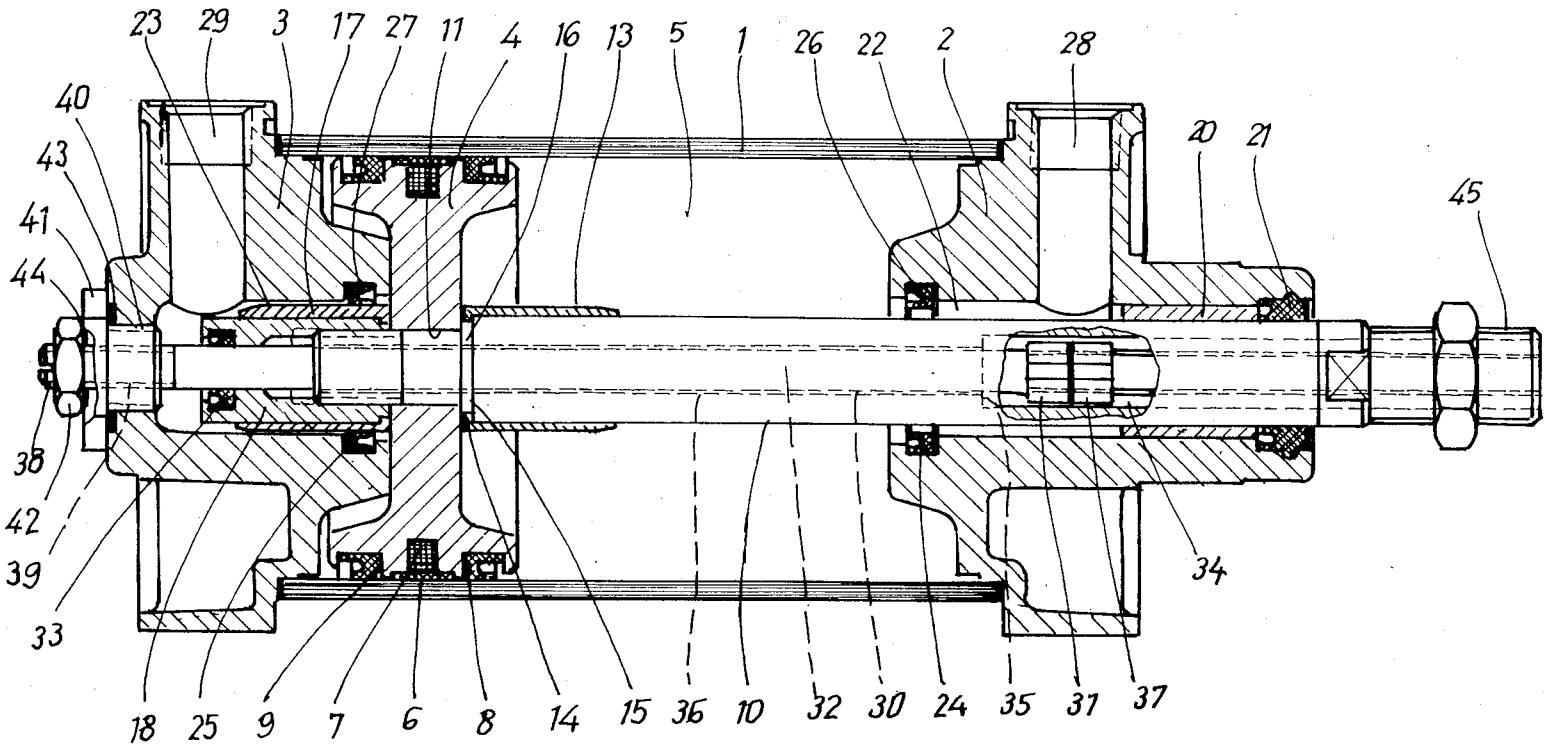
FIG. 1 is a longitudinal section of an actuator cylinder with its piston.
Figure 3:
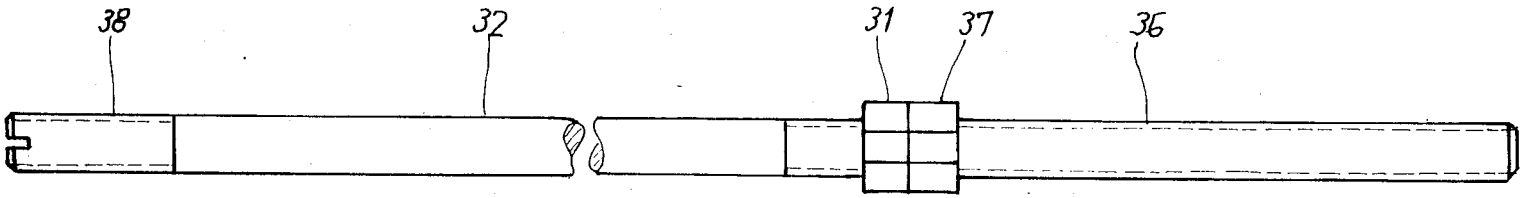
FIG. 3 shows the stop rod of the cylinder of FIG. 1 separately.

The actuator cylinder has a cylinder barrel 1 shut off at its ends by respective cylinder end plates 2 and 3. The piston 4 in the cylinder barrel 1 may reciprocate axially, it dividing the space in the barrel 1 into two space parts, one being referenced 5. In FIG. 1 the piston 4 is to be seen at the end of its stroke furthest from the first cylinder end plate 2 shown the right, or in other words the space part 5 next to the first cylinder end plate 2 has its largest volume. Peripherally and between its two ends in the axial direction the piston 4 possesses a slip ring 6 that is loaded in a radially outer direction by a ring 7 mounted in a piston groove. The ring 7 is made of material with rubber-like, elastic properties. The slip ring 6 is made of such a material that wear of the inner face of the cylinder barrel 1 is minimized. On the two sides of the slip ring 6 the piston 4 mounts respective sealing rings 8 and 9 which are let into grooves on the piston 4 and have sealing lips running out axially towards the respective end plates to engage the inner face or bore of the barrel 1.

Figure 2:
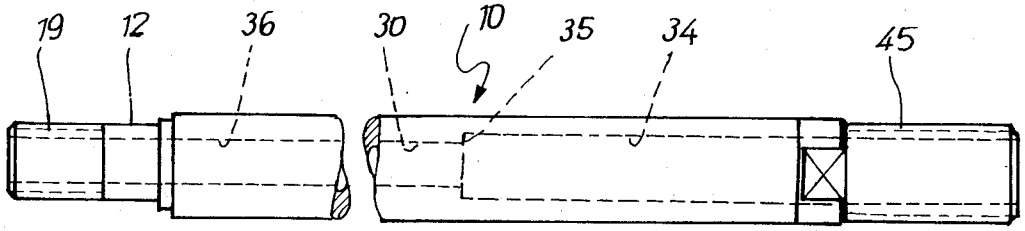
FIG. 2 shows the piston rod of the actuator cylinder of FIG. 1 separately.

The piston 4 is mounted on a piston rod 10, that is to be seen separately in FIG. 2. Accordingly in the illustrated example of the invention the piston 4 has a central through hole to receive the terminal part 12 of the piston rod 10. At the side of the piston 4 next to the end plate 2 there is a first damping piston 13 placed like a sleeve around the piston rod 10 and having a radially inwardly running collar 14 to fix it axially on the piston rod 10, because in the present example of the invention the piston rod is stepped in diameter, that is to say, the terminal part 12 of the rod is made with a smaller diameter and there is a shoulder or step 15 for the collar 14 to rest against while being kept in place by the piston 4. Between the terminal part 12 and the shoulder 15 there is an intermediate part 16 with a medium diameter whose axial length is equal to the wall thickness of the collar 14 (so that there is no danger of the collar 14 being deformed on assembly) and which has the piston 4 thrust against it axially.

To the other side of the piston 4, that is to the one side thereof facing the second cylinder end plate 3, there is a similar damping piston 17 partly surrounding an elongated securing nut 18 screwed onto the threaded end of the piston rod 10 to fix the piston 4 subassembly inclusive of the two damping pistons 13 and 17 onto the piston rod 10.

In connection with the present invention it is also possible for the piston 4 to be secured in some other way on the piston rod 10, as for example by screwing it directly on the piston rod 10 or molding the piston rod 10 and the piston 4 integrally. Furthermore in possible forms of the invention not illustrated herein it is possible to dispense with the damping pistons and the spaces therefor in the end plates as described hereinafter.

The piston rod 10 extends through the first end plate 2 to the outside. The piston rod 10 runs on a bearing sleeve 20 in the first cylinder end plate 2, at whose outer end there is a sealing ring 21, the same making sealing contact with the outer face of the piston rod 10.

Each damping piston 13 and 17 respectively is adapted to plunge in and out of a damping space 22 and 23 respectively in the respective end plate 2 and 3, the inner diameter of such spaces being somewhat greater than that of the respective damping piston 13 and 17. A groove 24 or 25 respectively is machined into the inner limit of each space 22 and 23 to mount a sealing ring 26 and 27 respectively, each such ring having a double sealing lip pointing towards the piston 4.

Lastly, each end plate 2 and 3 is furthermore fashioned with a port or connection 28 and 29 respectively joined via the damping spaces 22 and 23 with the interior of the barrel 1 for the inlet and outlet of fluid under pressure.

To cause the piston rod 10 to move outwards, the connection 29 is supplied with fluid under pressure, viz, in the present example, compressed air. Such air makes its way into the damping space 23 around the outer face of the damping piston 17 located therein as far as the sealing ring 27, whose inner lip engages the outer face of the damping piston 17. Dependent on the design of this sealing ring 27, the compressed air will then flow between the outer face of the damping piston 4 and the inner lip and/or between the outer lip and the inner face of the groove 25, the respective lip then giving away elastically to allow passage of such air. The compressed air then takes effect on the piston 4 and displaces it to the right in the present example, the piston rod 10 attached to the piston 4 being entrained therewith. When the piston 4 is so moved, the air in the space part 5 is forced out through the damping space 22, having the piston rod 10 therein, in the cylinder end plate 2 and leaves through the connection 28. Some time short of the termination of the outward stroke of the piston 4, the damping piston 13 enters the damping space 22 in the cylinder end plate 2, the inner lip of the seal 26 then engaging the outer face of the damping piston 13 so that the venting of air from the space part 5 of the cylinder is checked and a dashpot effect is obtained opposing and damping the motion of the piston 4 into its end position. For causing motion in the other, opposite direction the connection 28 is changed over from the discharge of air to the supply thereof and the connection 29 is switched over to discharge, whereafter the above events take place in the opposite direction.

The general idea of such a piston and cylinder as described is known, as is also the notion of having a stop and abutment for limiting outward motion of piston rod and arranging for adjustment of such abutment system to be by means at one end of the cylinder.

However in the invention the stop for checking the amount by which the piston rod is moved out of the barrel 1 is located inside the actuator cylinder. The moving plunger (formed by the piston 4 and the piston rod 10) has a coaxial hole 30 running through the piston rod 10 which has the piston 4 mounted on it. This hole 30 has a part 36 with a small diameter adjacent to the end plate 3 and a part 34 of large diameter. Where the two parts adjoin there is a step or shoulder 35 forming a radial abutment. The stop which cooperates with the shoulder 35 to limit outward motion of the piston rod is formed by an axially adjusting projection 31 placed in the part with a large diameter at least with sliding play. The projection 31 is mounted on a stop rod 32 that is attached to the second cylinder end plate 3 and runs out from it into the through axial hole 30. It extends through the part 36 with a small diameter of the axial hole 30 at least with sliding play and extends as far as the part 34 of the axial hole 30 with a large diameter, where it has the radial projection 31 for cooperation with the radial shoulder 35 and placed axially opposite to it.

It will furthermore be seen from the figures that in the present working example in the part between the second end plate 3 and the end of the piston rod the stop rod 32 extends through the sleeve-like nut 18 carrying the damping piston 17 and furnished with a seal 33 running on the stop rod 32. During operation of the actuator cylinder, the stop rod 32 with its radial projection 31 is stationary and the piston 4 with its piston rod 10 and the damping piston 17 (if fitted) constituting the moving plunger, run backwards and forwards along the stop rod 32.

It will be readily comprehended that when the piston rod 10 is displaced in the outward direction, the radial shoulder or step 35 in the axial hole moves closer to the radial projection 31 and then strikes against it so as to end the stroke of the plunger, this stroke limiting action taking place within the piston rod 10. This restriction of the maximum stroke length may be set, for which purpose, as will be described in more detail hereinafter, the radial projection 31 may be mounted on the stop rod 32 so as to permit axial adjustment relative thereto, and/or the stop rod 32 with the radial projection 31 thereon may be attached to the second cylinder end plate 3 in such a way that it may be adjusted from the outside.

It will be clear that the part 34 with a large diameter in the axial hole 30 of the piston rod will have a length at least equal to the desired range of setting. It is preferred for the part 34 with the large diameter to stretch as far as the free end of the piston rod 10 so that the piston rod 10 is hollow from one end to the other. For assembly, the stop rod 32 with the radial projection 31 thereon may then be inserted into the free end of the piston rod 10 and then slipped along as far as the second cylinder end plate 3.

If the radial projection 31 is to be fixed to the stop rod 32 so that it may be axially adjusted thereon, then this may be achieved in a very simple manner by designing the radial projection 31 in the form of a nut screwing onto a threaded end part 36 of the stop rod 32 and locking it in place by a lock nut 37 for example. In order to adjust or change the position of the radial projection 31 the stop rod 32 may be retracted from the axial hole 30 through the free end of the piston rod as noted so that the nut 37 may be accessed. The stop rod 32 will, in this case, be detachably fixed to the second cylinder end plate 3 for the adjustment of the radial projection 31 outside the actuator cylinder.

In order to secure the stop rod 32 on the second cylinder end plate 3 so that it may be adjusted from the outside, the present working example of the invention is so designed that the end portion 38 of the stop rod 32 has a male thread for some of its length, such screw-threaded part being screwed into the internally screw-threaded hole 39 in the second cylinder end plate 3. The rod 32 is able to be turned from the outside. Since such turning is possible, there is the additional possibility with this form of the invention of adjustment of the stop rod 32 together with the radial projection 31 inasfar as the stop rod is screwed in and out of the actuator cylinder when it is twisted. It is furthermore possible in this respect for the coarse setting of the maximum amount of extension of the piston rod 10 or of the length of the outward stroke to be undertaken by shifting the radial projection 31 on the stop rod 32 after slackening off the nut 37 and when this has been done and the stop rod has been put back in the piston rod 10 and put in through the cylinder end plate 3, the stop rod will be axially adjusted from the outside for fine setting of the position of the stop, that is to say of the radial projection 31, within the axial hole.

The stop rod 32 may be turned by hand using a screw-driver for example (that is fitted into a screw-driver slot in the end of the stop rod 32 as shown in the figure). In place of this the end part of the stop rod 32 supported in the second cylinder end plate 3 may be fitted with a servo motor for axial adjustment thereof.

It will be clear that as a general consideration it is not necessary to have both adjustment systems present at the same time and that furthermore in the working example small adjustments of the stroke size may be performed not by turning the stop nut but by screwing the stop rod inwards or outwards with respect to the cylinder end plate 3.

In the working example, the female threaded hole 39 in the cylinder end plate 3 is formed in a ring-like insert 40, that furthermore has a male screw thread with which it is screwed into a tapped hole in the cylinder end plate 3 as such. The stop rod 32 is furthermore locked in place in relation to the end plate 3 or washer 41 by a nut 42 screwed onto the male threaded part of the stop rod. In this case a seal is produced by sealing rings 43 and 44, of which the sealing ring 43 is placed on the outside of the cylinder end plate about the insert 40 so that the washer 41 is pressed against it. The other sealing ring 44 is located on the outside around the stop rod in the washer 41 so the securing nut 42 bears against it. At any event it is expedient for the radial shoulder 35 and the radial projection 31 to be ring-like so that the abutting action is radially symmetrical.

Finally it is to be noted that the free end part extending out of the cylinder end plate 2 of the piston rod 10 is fashioned with a male thread 45 to enable a part that is to be driven to be fixed to the piston rod.

I claim:

1. A fluid-driven cylinder comprising a cylinder barrel, first and second cylinder end plates attached to two opposite ends of said barrel, a movable plunger made up of a piston and a piston rod, said piston being slidably reciprocatable in said barrel, said piston being mounted on said piston rod and said piston rod having an end projecting through said first end plate, said piston rod and piston having a coaxial hole therethrough with a first part of small diameter adjacent said second end plate and a second part of large diameter merging into said first part of small diameter at a radial shoulder to act as an abutment, said second part of large diameter being on the side of said shoulder remote from said second end plate extending through said first end plate and out through said end of said piston rod, a stop rod extending in said hole from said second end plate to which it is attached, said stop rod having an external thread in the region of said second part of large diameter, a radial projection threaded onto said external thread of said stop rod at a point thereof remote from said second end plate, said projection being disposed in said second part of large diameter with at least sliding play and forming a stop, said stop rod fitting within said first part of small diameter with at least sliding play, said stop rod being rotatably mounted to said second cylinder end plate, and means for axial adjustment of said projection by rotation of said stop rod.

2. A fluid-driven cylinder according to claim 1, wherein said radial projection comprises an adjusting nut threaded to said external thread of said stop rod and a lock nut threaded to said external thread of said stop rod and engaged firmly against said adjusting nut.

3. A fluid-driven cylinder according to claim 2, wherein said stop rod is detachably rotatably mounted to said second end plate so as to be removable from said hole through said end of said piston rod, said adjusting nut and lock nut being axially adjustable on said stop rod for coarse adjustment and said stop rod being rotatable by said means when said stop rod is rotatably mounted to said second cylinder end plate for fine adjustment.

4. A fluid-driven cylinder according to claim 3, wherein said second cylinder end plate has an internal thread, said stop rod having a threaded end threaded into said second cylinder end plate and being rotatable by said means for fine adjustment.

5. A fluid-driven cylinder according to claim 4, including a fastening nut threaded onto said threaded end of said stop rod and a washer engaged between said fastening nut and said second cylinder end plate for holding said stop rod in a selected axial position.

* * * * *